US008960852B2

(12) United States Patent
Tokai

(10) Patent No.: US 8,960,852 B2
(45) Date of Patent: Feb. 24, 2015

(54) RECORDING APPARATUS

(71) Applicant: Seiko Epson Corporation, Tokyo (JP)

(72) Inventor: Yoshitsugu Tokai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/219,873

(22) Filed: Mar. 19, 2014

(65) Prior Publication Data

US 2014/0292876 A1 Oct. 2, 2014

(30) Foreign Application Priority Data

Mar. 27, 2013 (JP) ..... 2013-065985

(51) Int. Cl.
*B41J 29/393* (2006.01)
*B41J 3/28* (2006.01)
*B41J 25/308* (2006.01)

(52) U.S. Cl.
CPC ..... *B41J 3/28* (2013.01); *B41J 25/3088* (2013.01)
USPC ..... 347/19

(58) Field of Classification Search
USPC ..... 347/19
See application file for complete search history.

(56) References Cited

U.S. PATENT DOCUMENTS

2005/0151773 A1 7/2005 Watarai

FOREIGN PATENT DOCUMENTS

| | | |
|---|---|---|
| JP | 2005-199507 | 7/2005 |
| JP | 2005-335247 | 12/2005 |
| JP | 2006-240082 | 9/2006 |
| JP | 2010-221644 | 10/2010 |
| JP | 2012-210781 | 11/2012 |

*Primary Examiner* — Lamson Nguyen
(74) *Attorney, Agent, or Firm* — Workman Nydegger

(57) ABSTRACT

There is provided a recording apparatus including a support stage which support a recording medium, a recording processing section which includes a recording unit for performing recording on the supported recording medium and is bridged so as to cross over the support stage in an X-axis direction, a Y-axis moving section which moves the recording processing section in a Y-axis direction with respect to the support stage, a rear bumper section which is arranged on the rear side of the recording processing section in the Y-axis direction and absorbs impact from collision with a foreign matter, and a first detection section which detects whether or not a distance between the recording medium A and the recording unit is less than a predetermined value, in which at least a part of the first detection section is arranged inside the rear bumper section.

7 Claims, 10 Drawing Sheets

RECORDING APPARATUS

BACKGROUND

1. Technical Field

The present invention relates to a so-called flatbed type recording apparatus which performs recording by moving a recording unit with respect to a recording medium on a stage.

2. Related Art

In the related art, a recording apparatus which includes a stage section for supporting a recording medium, a recording unit facing the stage section, a Y bar (Y-axis support member) for supporting the recording unit such that the recording unit can reciprocate in a main scanning direction (Y-axis direction), a pair of support pillars for supporting both ends of the Y bar, and an X-axis moving mechanism for moving the recording unit in a sub scanning direction (X-axis direction) via the respective support pillars coupled thereto and the Y bar has been known (see JP-A-2012-210781).

Incidentally, it is considered that a detection section for detecting whether or not a distance between the recording unit and a recording medium is a predetermined distance is mounted on such a recording apparatus.

However, there is a problem in that it is necessary to provide a special arrangement space for the detection section in order to simply mount the detection section and the size of the apparatus increases as a whole.

SUMMARY

An advantage of some aspects of the invention is to provide a recording apparatus capable of arranging a detection section efficiently in terms of a space.

According to an aspect of the invention, there is provided a recording apparatus including: a stage which includes a support surface for supporting a recording medium; a recording processing section which includes a recording unit for performing recording on the recording medium supported by the stage and is bridged so as to cross over the stage in a first direction; a moving section which moves the recording processing section in a second direction perpendicular to the first direction and along the support surface, with respect to the stage; a bumper section which is arranged on at least one of one side and the other side of the recording processing section in the second direction and absorbs impact from collision with a foreign matter; and a detection section which detects whether or not a distance between the recording medium and the recording unit in a facing direction of the recording unit and the stage is less than a predetermined value, in which at least a part of the detection section is arranged within the bumper section.

With such a configuration, it is not necessary to provide a special arrangement space for the detection section by arranging the detection section by using an inner space of the bumper section for absorbing impact. Accordingly, it is possible to arrange the detection section efficiently in terms of a space and to reduce the size of the recording apparatus as a whole.

In this case, it is preferable that the recording apparatus further include a sensor section which detects a behavior of the bumper section which collides with the foreign matter.

With such a configuration, it is possible to detect that the foreign matter has collided with the recording processing section and to thereby quickly stop driving the moving section, for example, at this timing.

In this case, it is preferable that the detection section include a contact section which is able to be brought into contact with the recording medium, a rotation shaft which is supported by the bumper section and rotatably supports a base of the contact section, a posture maintaining member which maintains a posture of the contact section, and a rotation detection section which detects rotation of the contact section in contact with the recording medium.

With such a configuration, the contact section rotates, and the rotation detection section detects the rotation, if the recording medium is brought into contact with the contact section when the recording processing section moves. As described above, it is possible to detect whether or not the distance between the recording medium and the recording unit is less than the predetermined value with a simple configuration without damaging the surface of the recording medium as much as possible. In addition, since it is possible to detect whether or not the distance between the recording medium and the recording unit is less than the predetermined value at the respective positions in the second direction, it is possible to detect unevenness or bending (floating) even if the unevenness or the bending (floating) occurs in the second direction and the distance is partially less than the predetermined value.

In this case, it is preferable that the detection section include a plurality of contact sections which are aligned and arranged in the first direction and are able to be brought into contact with the recording medium when the recording processing section moves, a rotation shaft which is supported by the bumper section and rotatably supports bases of the plurality of contact sections, a posture maintaining member which maintains postures of the plurality of contact sections, and a plurality of rotation detection sections which respectively detect rotation of the respective contact sections in contact with the recording medium.

With such a configuration, the respective contact sections rotate, and the rotation detection sections detect the rotation, if the recording medium is brought into contact with the respective contact sections when the recording processing section moves. As described above, it is possible to detect whether or not the distance between the recording medium and the recording unit is less than the predetermined value with a simple configuration without damaging the recording medium as much as possible. In addition, since it is possible to detect whether or not the distance between the recording medium and the recording unit is less than the predetermined value at the respective positions in the second direction, it is possible to detect unevenness or bending (floating) even if the unevenness or the bending (floating) occurs in the second direction and the distance is partially less than the predetermined value. Furthermore, it is possible to precisely detect unevenness or bending (floating) by using the plurality of contact sections aligned and arranged in the first direction and the plurality of rotation detection sections for detecting the rotation of the respective contact sections even if the unevenness or the bending (floating) occurs in the first direction and the distance is partially less than the predetermined value. Moreover, since the width of each contact section is narrower than the width of the recording medium, the contact sections are not easily bent, and it is possible to precisely form tip ends thereof (tip ends on the side of the recording medium) and to arrange the contact sections at positions which are as close as possible to the recording medium (improvement in detecting precision).

In this case, it is preferable that the recording apparatus further include an informing section which provides information about detection results of the respective rotation detection sections.

With such a configuration, it is possible for a user to easily recognize at which position in the second direction on the recording medium unevenness or bending (floating) occurs.

In this case, it is preferable that the rotation detection section be fixed to the contact sections, be relatively pressurized toward an inner surface of the bumper section during the rotation, and detects the rotation of the contact sections by the pressurization.

With such a configuration, it is not necessary to provide a special arrangement space for the rotation detection sections by arranging the rotation detection sections over the contact sections. Accordingly, it is possible to reduce the size of the detection section and to easily arrange the detection section inside the bumper section.

In this case, it is preferable that the bumper section support the posture maintaining member such that the posture maintaining member freely slides between a pressing position at which the contact sections are pressed and a retreat position retreating from the pressing position, and that the detection section further include a bias spring which biases the posture maintaining member to a side of the pressing position.

There is a concern that the contact sections and the recording medium will be damaged when the recording processing section is moved from the front side to the rear side in the second direction and strong burden is applied to the contact sections, which are brought into contact with the recording medium from the rear side thereof, since rotation toward the front side is interrupted by the posture maintaining member and the burden is not released.

In contrast, the posture maintaining member slides from the pressing position to the retreat position against the bias force of the bias spring and permits the rotation of the contact sections toward the front side according to the aforementioned configuration, when such strong burden is applied. It is possible to release the burden as described above and to thereby prevent a contact piece and the recording medium from being damaged.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a description will be given of a recording apparatus according to an embodiment of the invention with reference to the accompanying drawings. The recording apparatus records a desired image on a recording medium by ejecting ultraviolet curable ink based on an ink jet scheme. In addition, the recording apparatus is a so-called flatbed type recording apparatus which performs recording by moving a recording head with respect to the recording medium supported by a support stage. As the recording medium, recording media with different thicknesses, such as a paperboard, a wood material, a tile, a plastic board, and cardboard, are assumed. An X-axis (horizontal) direction, a Y-axis (front-back) direction, and a Z-axis (upper-lower) direction are defined as shown in the respective drawings, and the following description will be given. The Y-axis direction and the X-axis direction are directions along a support surface (set surface) of the support stage. A near side in FIG. 1 is referred to as a front side of the recording apparatus, and a far side in FIG. 1 is referred to as a rear side of the recording apparatus.

Figure 1:
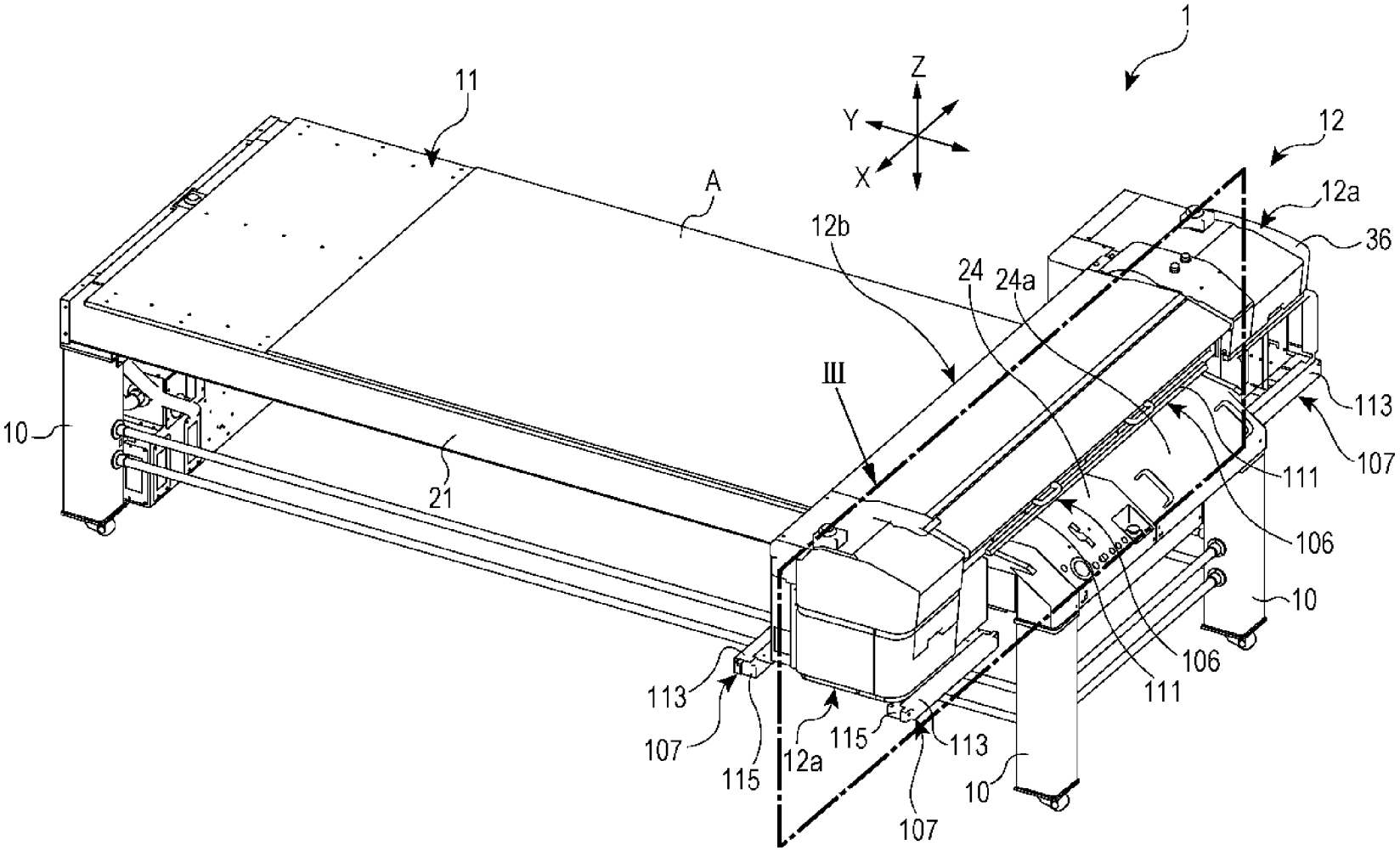
FIG. 1 is a perspective view showing an appearance of a recording apparatus according to an embodiment.
Figure 2:
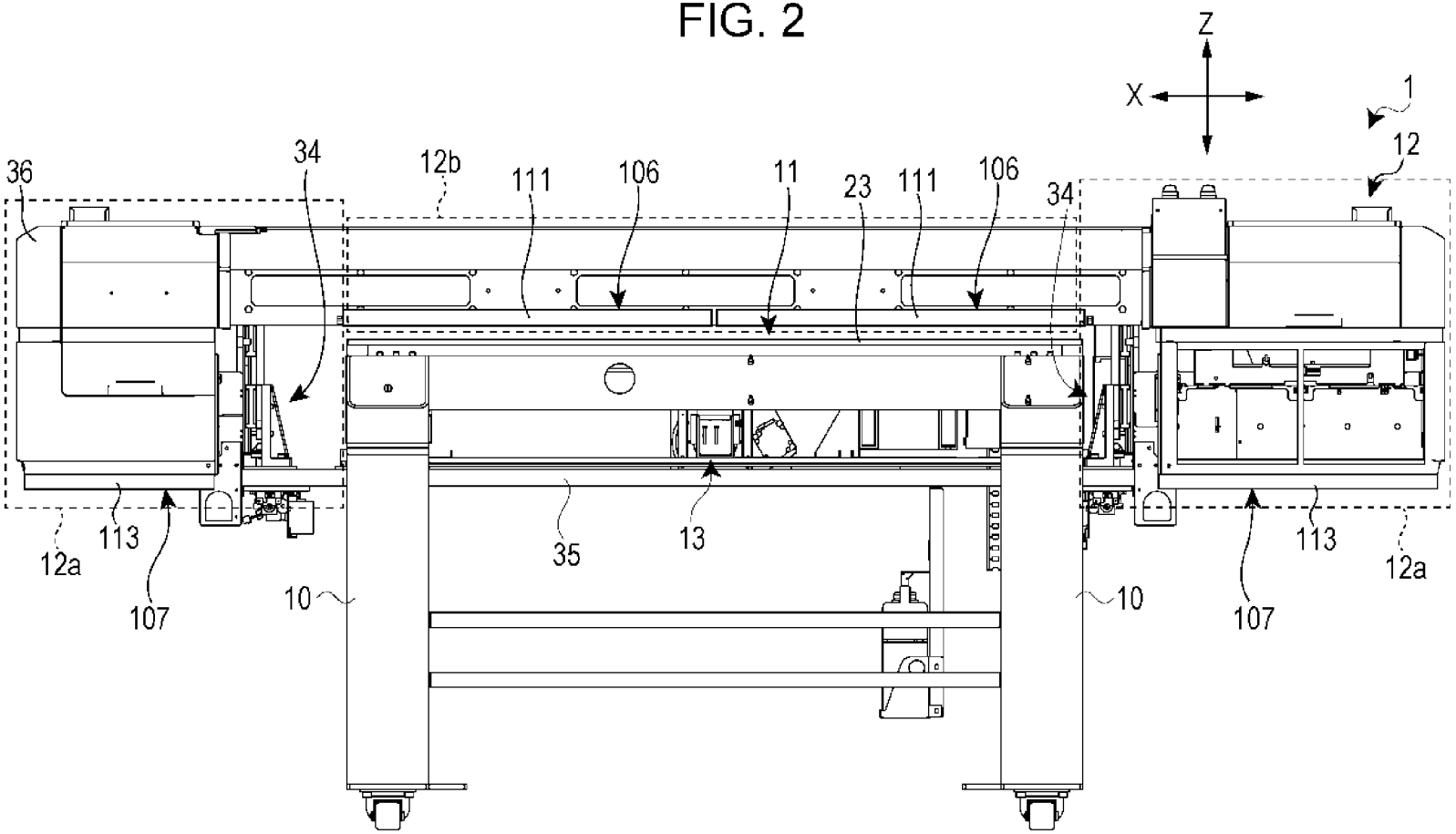
FIG. 2 is a front view showing the recording apparatus, in which a part of a support stage and a part of an apparatus cover are omitted.

As shown in FIGS. 1 and 2, a recording apparatus 1 is supported by four leg materials 10 with wheels and includes a support stage (stage) 11 for supporting a recording medium A, a gantry type recording processing section 12 with a recording unit 31 facing the supported recording medium A, and a Y-axis moving section (moving section) 13 for supporting the recording processing section 12 and moving the recording processing section 12 in the Y-axis direction (second direction) with respect to the support stage 11. The recording processing section 12 is bridged so as to cross over the support stage 11 in an X-axis direction (first direction). In contrast, the Y-axis moving section 13 is arranged so as to be overlapped with the support stage 11 on the rear surface side of the support stage 11 and movably supports the recording processing section 12 on the rear surface side of the support stage 11.

Figure 7:
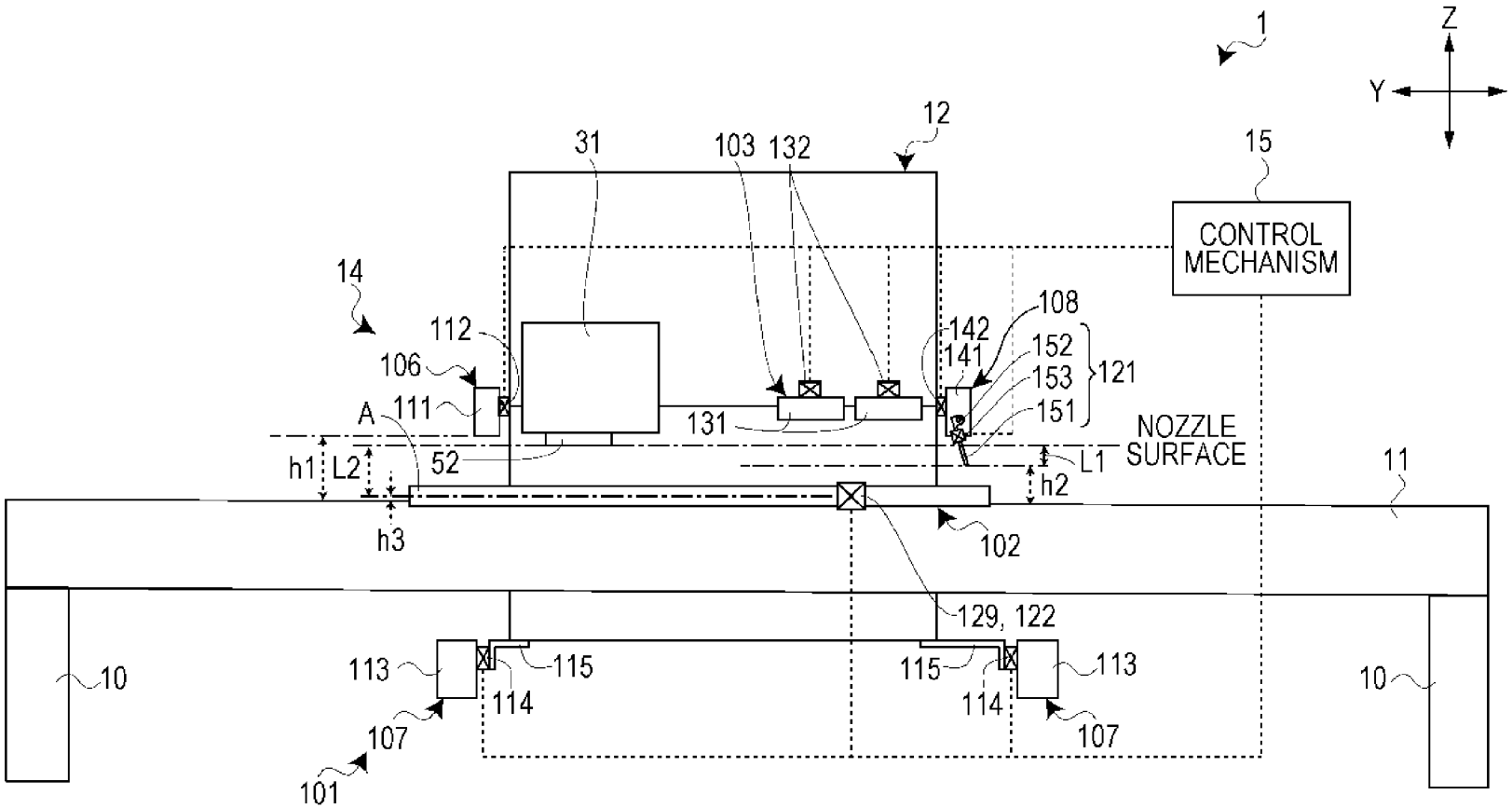
FIG. 7 is an outline of a side view showing a detection mechanism.

In addition, the recording apparatus 1 includes a detection mechanism 14 for detecting collision of a foreign matter and a height of the recording medium A, and a control mechanism 15 for controlling the aforementioned respective components (see FIG. 7 for both the detection mechanism 14 and the control mechanism 15). The control mechanism 15 stops driving the Y-axis moving section 13, for example, based on a detection result of the detection mechanism 14.

Figure 3:
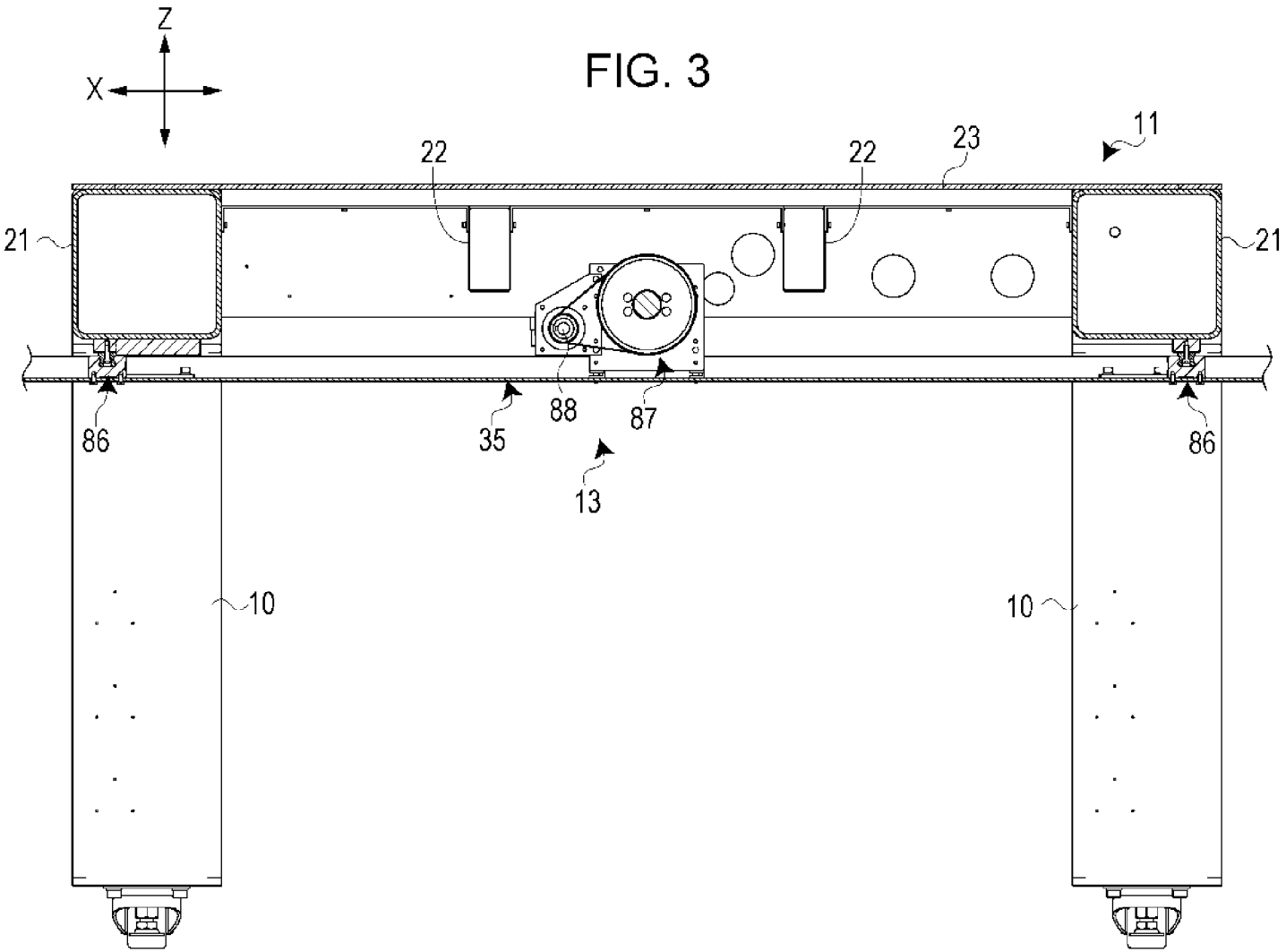
FIG. 3 is an III-plane cross-sectional view showing a circumference of the support stage and a Y-axis moving section.

Next, a description will be given of the support stage 11 with reference to FIGS. 1 to 3. FIG. 3 is an III-plane cross-sectional view of a circumference of the support stage 11 and the Y-axis moving section 13 when viewed from the rear side. As shown in FIGS. 1 to 3, the support stage 11 includes a pair of right and left beam-shaped structure materials 21 extending in the Y-axis direction, a plurality of support materials 22 arranged in longitudinal and latitude directions between the pair of structure materials 21, a suctioning table 23, which is supported by the pair of structure materials 21 and the plurality of support materials 22, and by and on which the recording medium A is suctioned and set, and an operation panel section 24 arranged in front of the suctioning table 23. The suctioning table 23 includes a support surface for supporting the recording medium A. In addition, the support stage 11 is supported by the respective leg materials 10 at the ends of the respective structure materials 21. A wide opening and closing door 24*a* is provided at the right half of the operation panel section 24. When the recording processing section 12 is manually maintained, the maintenance of the recording processing section 12 is performed from the opening and closing door 24*a* by moving the recording processing section 12 to the near side (the front side in the Y-axis direction) and opening the opening and closing door 24*a*.

Figure 4:
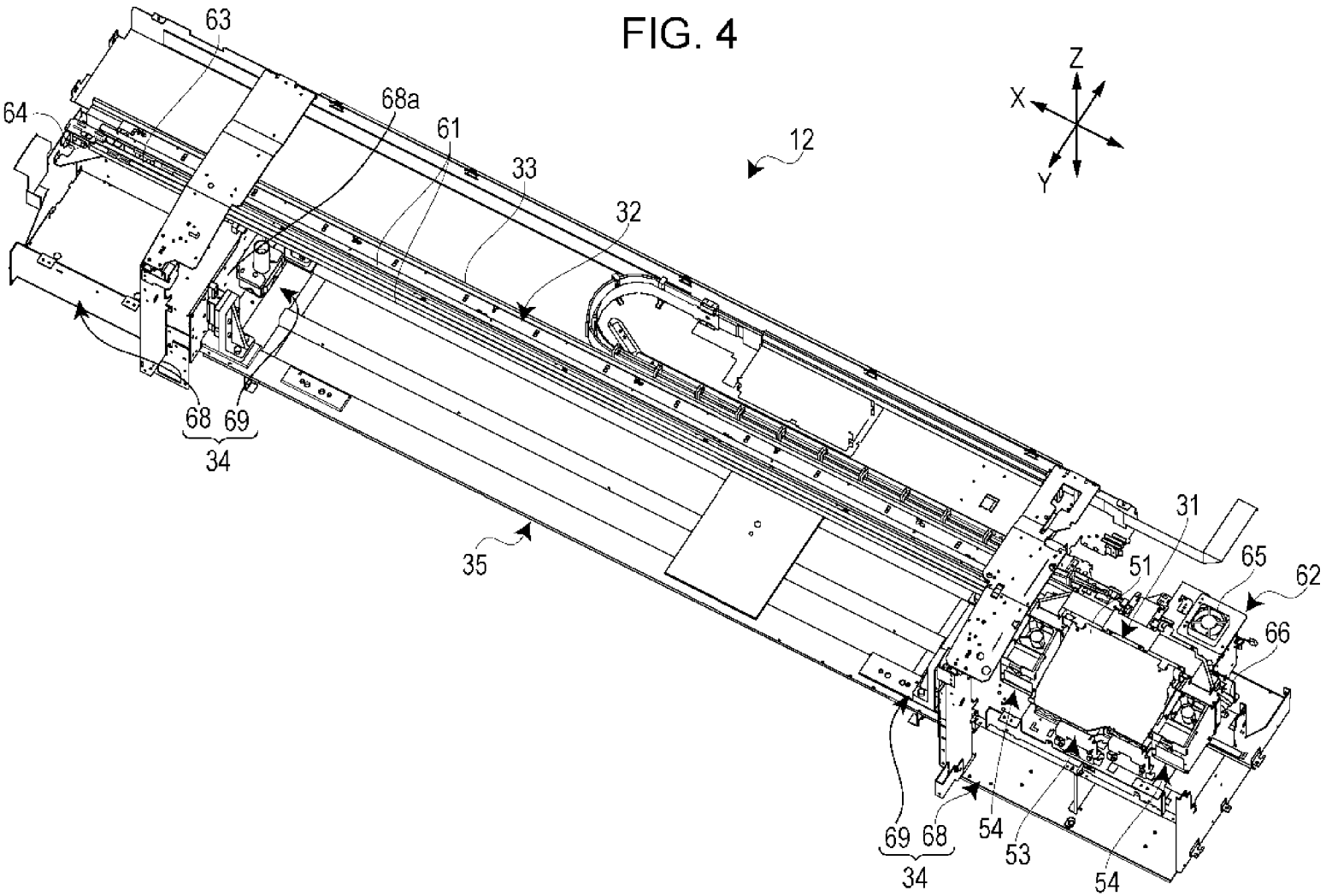
FIG. 4 is a perspective view showing a recording processing section, in which the apparatus cover is omitted.
Figure 5:
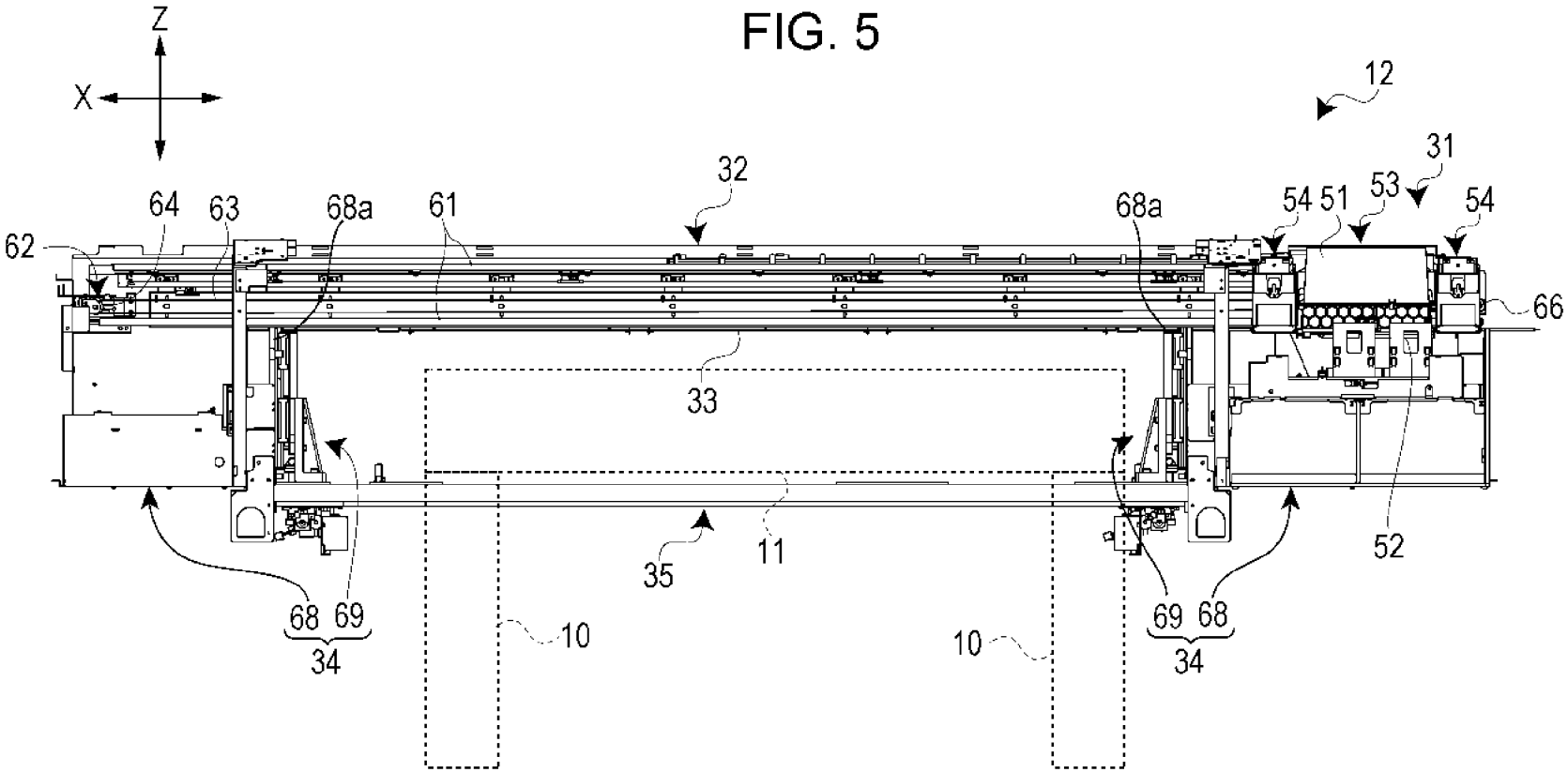
FIG. 5 is a front view showing the recording processing section, in which the apparatus cover is omitted.

As shown in FIGS. 4 and 5, the recording processing section 12 includes a recording unit 31 facing the supported recording medium A, an X-axis moving section 32 for supporting the recording unit 31 and moving the recording unit 31 in the X-axis direction, an erect laterally bridged frame 33 for supporting the X-axis moving section 32, a pair of right and left side frames 34 for supporting the laterally bridged frame 33 on both sides in the X-axis direction, a coupling frame 35 which couples base end sides of the pair of side frames 34, and an apparatus cover 36 (see FIG. 1) for covering these components. The laterally bridged frame 33 extends in the X-axis direction so as to cross over the support stage 11. In addition, the respective side frames 34 extend up to a lower part of the support stage 11, and the coupling frame 35 is coupled to lower ends of both of the side frames 34 below the support stage 11. Moreover, the Y-axis moving section 13 is arranged above the coupling frame 35 and couples the coupling frame 35 to the support stage 11.

As shown in FIGS. 1 and 2, the recording processing section 12 includes a pair of projecting portions 12*a* horizontally projecting from the support stage 11. That is, the recording processing section 12 includes a pair of right and left projecting portions 12*a* projecting in the X-axis direction with respect to the support stage 11 and an overlapped portion 12*b* overlapped with the support stage 11 in the X-axis direction on the surface side (upper side) of the support stage 11.

As shown in FIGS. 4 and 5, the recording unit 31 includes a carriage unit 53 on which two recording heads 52 is mounted and a pair of ultraviolet irradiation units 54 arranged on the right and left sides of the carriage unit 53. The respective ultraviolet irradiation units 54 include ultraviolet irradiation LEDs for ultraviolet irradiation and irradiate ultraviolet curable ink ejected and landed by the recording head 52 with ultraviolet rays to cure (fix) the ultraviolet curable ink.

Each of the recording heads 52 is an ink jet head which is driven by a piezoelectric element (piezo element) to eject ink and includes a plurality of nozzle arrays (not shown) corresponding to colors which extend in the Y-axis direction. That is, the respective recording heads 52 are configured to be able to eject ultraviolet curable ink corresponding to a plurality of colors. In addition, nozzle surfaces of the recording heads 52 face the recording medium A. Moreover, the nozzle surfaces of the two recording heads 52 have the same heights. Although the ink jet heads based on a piezoelectric scheme is used in this embodiment, the invention is not limited thereto, and an ink jet head based on a thermal scheme, an electrostatic scheme, or the like may be used. In addition, the invention is not limited to such on-demand ink jet heads, and a continuous ink jet head may be used.

The X-axis moving section 32 includes a pair of upper and lower guide shafts 61 which are supported by the laterally bridged frame 33 and support the recording unit 31 such that the recording unit 31 can freely reciprocate in the X-axis direction and an X-axis drive mechanism 62 which directly drives the recording unit 31 along the pair of guide shafts 61.

The X-axis drive mechanism 62 includes a timing belt 63 extending in the X-axis direction along the pair of guide shafts 61, a main driving pulley 66 and a driven pulley 64 over which the timing belt 63 is stretched, a coupling and fixing section (not shown) which couples the timing belt 63 and the recording unit 31 (carriage 51), and a carriage motor 65 which drives the main driving pulley 66. The X-axis moving section 32 causes the recording unit 31 to reciprocate in the X-axis direction on the pair of guide shafts 61 via the timing belt 63 by rotating the carriage motor 65 in forward and reverse directions. The recording processing is performed by driving the respective recording heads 52 to eject ink along with the reciprocation.

Figure 6:
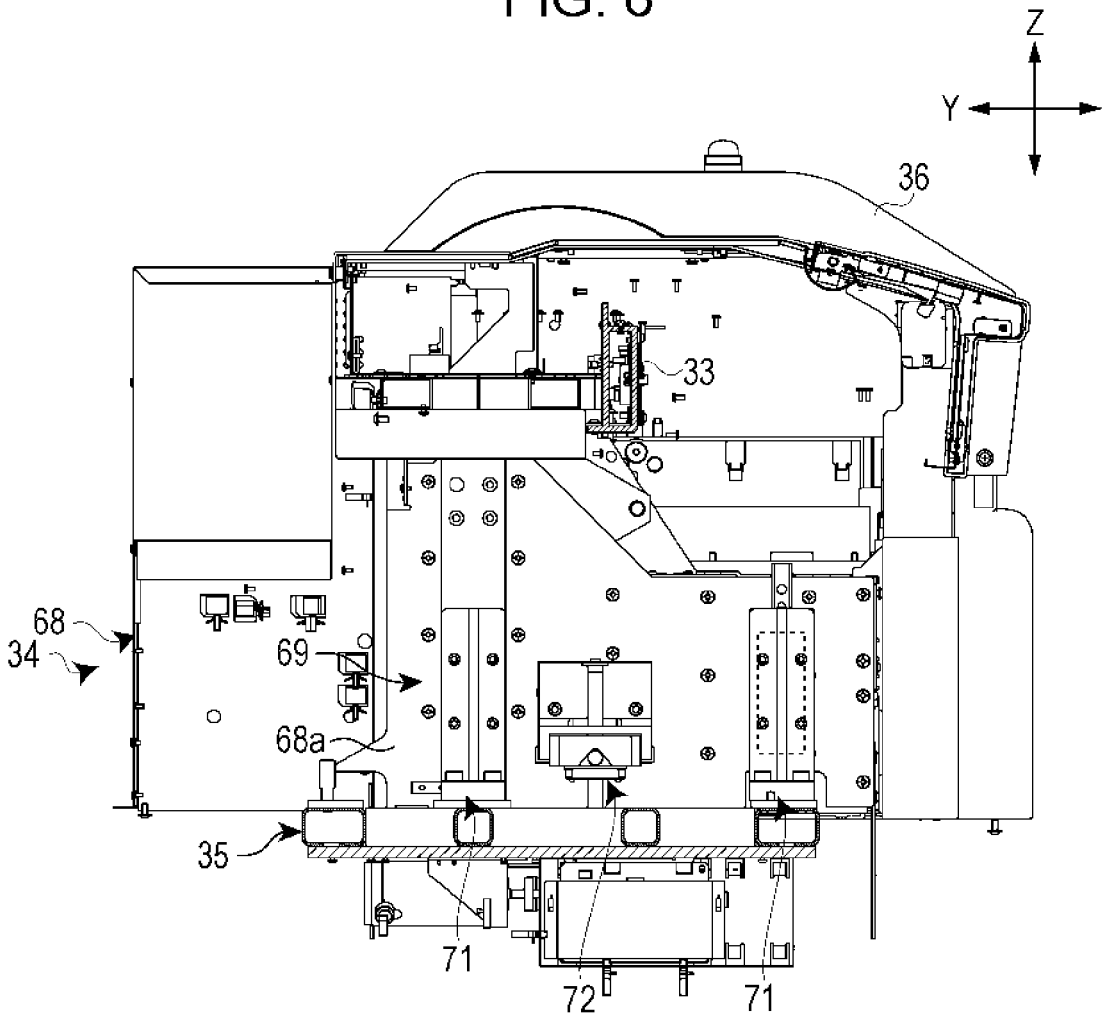
FIG. 6 is an inner side view showing a circumference of a side frame and an elevation section embedded therein.

Next, a description will be given of the side frames 34 with reference to FIGS. 4 to 6. As shown in FIGS. 4 to 6, an elevation section 69 for moving the recording unit 31 in the upper-lower direction and causing the recording unit 31 to approach and separate from the support stage 11 is embedded in each side frame 34. Specifically, each side frame 34 includes a box-shaped frame main body 68 for supporting the laterally bridged frame 33 and the elevation section 69 for coupling the frame main body 68 and the coupling frame 35 and moving the frame main body 68 up and down.

The pair of side frames 34 moves the recording unit 31 up and down via the respective frame main bodies 68, the laterally bridged frame 33, and the X-axis moving section 32 by causing the respective elevation sections 69 to move the frame main bodies 68 up and down. With such an operation, the recording unit 31 is made to approach and separate from the support stage 11 and the recording medium A supported by the support stage 11 (gap adjustment). That is, the respective frame main bodies 68, the laterally bridged frame 33, the X-axis moving section 32, the recording unit 31, and the apparatus cover 36 which covers these components are moved up and down by the respective elevation sections 69. Accordingly, movable bodies which are moved up and down by the elevation sections 69 are the respective frame main bodies 68, the laterally bridged frame 33, the X-axis moving section 32, the recording unit 31, and the apparatus cover 36.

The frame main bodies 68 support the laterally bridged frame 33 and include fixing plate sections 68*a* therein (on the side of the support stage 11) for fixing the movable sides of the respective elevation sections 69.

Each elevation section 69 includes a pair of front and back elevation guide mechanisms 71 which supports the frame main body 68 with respect to the coupling frame 35 such that the frame main body 68 can freely move up and down, an elevation drive mechanism 72 which is arranged between the pair of elevation guide mechanisms 71 and directly drives the frame main body 68 in the upper-lower direction, and an elevation drive motor (not shown) which drives the elevation drive mechanism 72. The respective elevation guide mechanisms 71 are configured of LM guide (registered trademark) mechanisms. In addition, the elevation drive mechanism 72 is configured of a ball screw mechanism.

As shown in FIG. 3, the Y-axis moving section 13 includes a pair of right and left linear guide mechanisms 86 which are positioned at both right and left ends of the support stage 11 on the rear side and support the recording processing section 12 with respect to the support stage 11 such that the recording processing section 12 can freely slide in the Y-axis direction, a Y-axis moving mechanism 87 which is positioned at the center of the support stage 11 on the rear side and moves the recording processing section 12 in the Y-axis direction with respect to the support stage 11, and a drive motor 88 which drives the Y-axis moving mechanism 87. The respective linear guide mechanisms 86 are configured of LM guide mechanisms. In addition, the Y-axis moving mechanism 87 is configured of a ball screw mechanism.

Figure 8:
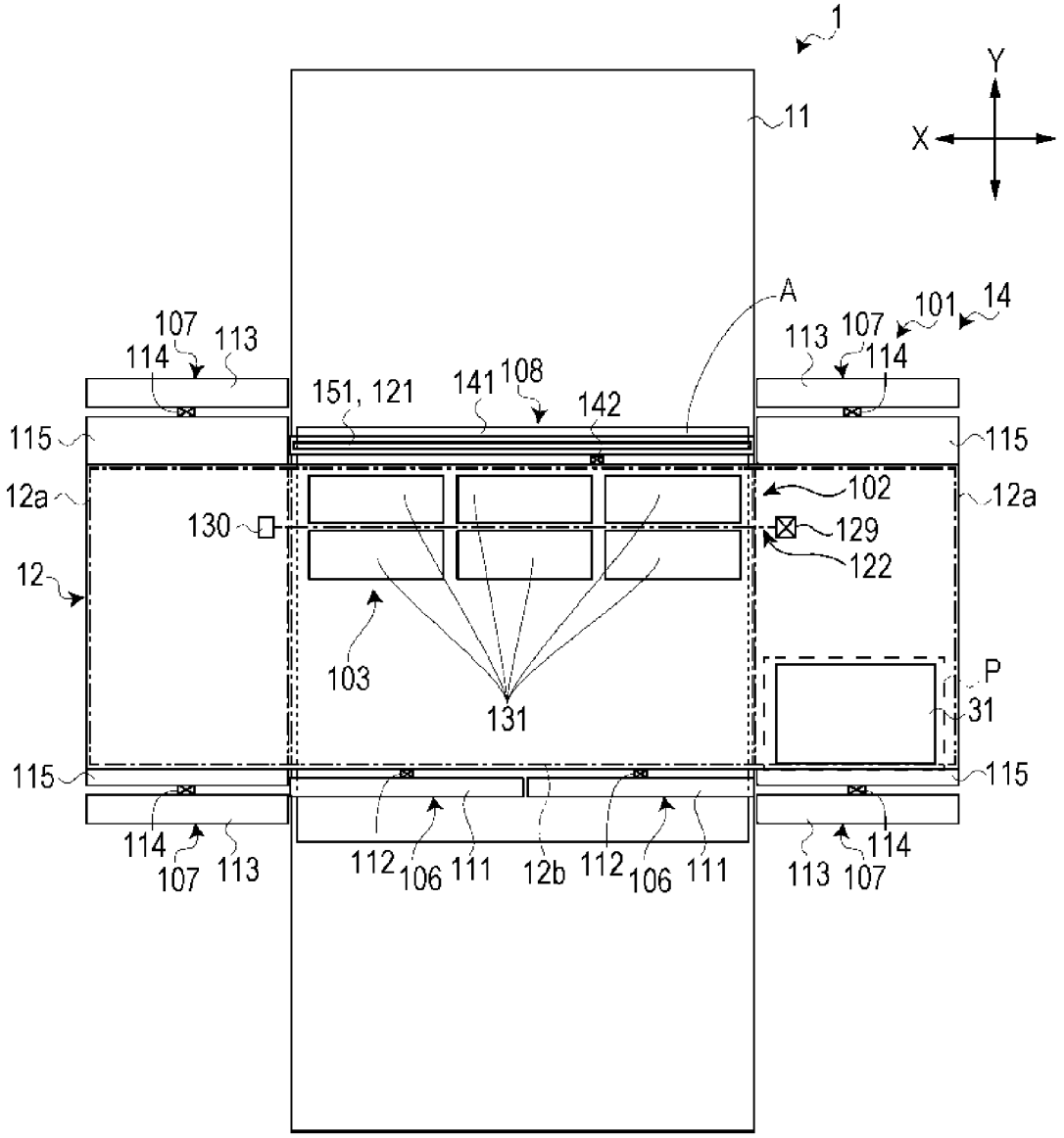
FIG. 8 is an outline of a front view showing the detection mechanism.

Next, a description will be given of the detection mechanism 14 with reference to FIGS. 1 and 7 to 9. As shown in FIGS. 7 and 8, the detection mechanism 14 includes collision detection sections 101, a medium detection section 102, and an elevation collision detection section 103. The collision detection sections 101 are arranged on one side and the other side (front and rear sides) of the recording processing section 12 in the Y-axis direction and detects that a foreign matter has collided with the recording processing section 12 moved by the Y-axis moving section 13. The medium detection section 102 faces a front surface side and a side surface side of the recording medium A and detects a distance between the nozzle surface of the recording head 52 and the end of the recording medium A on the side of the recording head 52 in the Z-axis direction (a direction in which the recording unit 31 faces the support stage 11). In other words, the medium detection section 102 detects the height of the recording medium A (a distance from the support surface of the suctioning table 23 to the upper end of the recording medium A). The elevation collision detection section 103 is mounted on the recording processing section 12 at a position facing the support stage (recording medium A) and detects that a foreign matter has collided with the movable bodies moved up and down by the elevation section 69.

As shown in FIGS. 1, 7, and 8, each collision detection section 101 includes two right and left front collision detection sections 106 arranged in front of (one side in the Y-axis direction) of the overlapped portion 12*b* of the recording processing section 12, four side collision detection sections 107 arranged on front and rear sides (the other side in the Y-axis direction) of each projecting portion 12*a* of the recording processing section 12, and a rear collision detection section 108 arranged on the rear side of the overlapped portion 12*b* of the recording processing section 12.

Each front collision detection section 106 includes, in front of the overlapped portion 12*b*, a front bumper section 111 arranged at a lower end of the overlapped portion 12*b* and a front sensor section 112 arranged on the rear side of the front bumper section 111 to detect a behavior of the front bumper section 111.

The front bumper section 111 is supported with respect to the recording processing section 12 so as to freely advance and retreat in the front-back direction and is biased by a pressurizing spring, which is not shown in the drawing, in a direction away from the apparatus cover 36. The front bumper section 111 absorbs impact when a foreign matter collides by a hollow structure thereof and bias force of the pressurizing spring. The front bumper section 111 moves against the bias force of the pressurizing spring when brought into contact with a foreign matter or the recording medium A. The front sensor section 112 detects the movement of the front bumper section 111 caused by the contact with the foreign matter or the recording medium A and detects collision of the foreign matter or the recording medium A. As shown in FIG. 8, the two front bumper sections 111 of the two front collision detection sections 106 are aligned and arranged in the X-axis direction. A total width of the two front bumper sections 111 in the X-axis direction is a width covering the entire width of the overlapped portion 12*b* (the length in the X-axis direction). When unevenness or bending (floating) occurs in the recording medium A in the X-axis direction, and the uneven or bent part partially exceeds a predetermined height, it is possible to precisely detect the unevenness or bending with the aforementioned configuration.

In addition, the respective front collision detection sections 106 are arranged such that the recording medium A is brought into contact with the front bumper sections 111 when the height of the recording medium A is equal to or greater than a first upper limit value h1. That is, the respective front collision detection sections 106 can detect whether or not the height of the recording medium A is equal to or greater than the first upper limit value h1. The height corresponding to the first upper limit value h1 is higher than the nozzle surface of the recording head 52.

Each side collision detection section 107 includes, on the front and rear sides of each projecting portion 12*a*, a side bumper section 113 arranged at a lower end of each projecting portion 12*a* via an arrangement member 115 and a side sensor section 114 arranged on the rear surface side of the side bumper section 113 to detect a behavior of the side bumper section 113. A configuration of the side bumper section 113 is the same as that of the aforementioned front bumper section 111, thus detailed description will be omitted. The side sensor section 114 detects movement of the side bumper section 113 caused by contact with a foreign matter and detects collision of the foreign matter. In addition, each side bumper section 113 has a width (a length in the X-axis direction) covering the entire width of each projecting portion 12*a*.

As shown in FIG. 7, each side bumper section 113 is arranged by the arrangement member 115 at a lower position than the lower end of the projecting portion 12*a* in the vertical direction (Z-axis direction). In addition, each side bumper section 113 is arranged at a lower position than the support stage 11 in the vertical direction. Furthermore, the position of each side bumper section 113 in the vertical direction is set at a lower position than the lower surface of the support stage 11 by a length corresponding to a standard arm thickness in order to detect an arm of a user when the user curls their arm around the leg materials 10.

In addition, each side bumper section 113 of the side collision detection section 107 arranged in front of the projecting portion 12*a* is arranged by the arrangement member 115 at a position projecting further forward than the front bumper section 111 in the Y-axis direction.

As shown in FIGS. 7 and 8, the medium detection section 102 includes a first detection section (detection section) 121 which faces the front surface side of the recording medium A and detects whether or not a distance between the nozzle surface of the recording head 52 and the recording medium A is less than a first predetermined value L1 and a second detection section 122 which faces the side surface side of the recording medium and A detects whether or not the distance between the nozzle surface of the recording head 52 and the recording medium A exceeds a second predetermined value L2 (L1<L2). The first predetermined value L1 is a lower limit value of the distance between the nozzle surface and the recording medium A, with which it is possible to normally perform recording on the recording medium A when the recording head 52 is arranged at a predetermined position in the Z-axis direction. The second predetermined value L2 is an upper limit value of the distance between the nozzle surface and the recording medium A, with which it is possible to normally perform recording on the recording medium A when the recording head 52 is arranged at a predetermined position in the Z-axis direction. In this embodiment, the first predetermined value L1 is 1.0 mm, and the second predetermined value L2 is 5.0 mm.

In other words, the first detection section 121 detects whether or not the height of the recording medium A exceeds a predetermined second upper limit value h2 (h2<h1), and the second detection section 122 detects whether or not the height of the recording medium A is less than a predetermined lower limit value h3 (h3<h2). The height corresponding to the second upper limit value h2 is lower than the recording head 52. The second upper limit value h2 corresponds to the aforementioned first predetermined value L1, and the lower limit value h3 corresponds to the aforementioned second predetermined value L2.

Both the first detection section 121 and the second detection section 122 are mounted on the recording processing section 12. Furthermore, the first detection section 121 and the second detection section 122 are mounted on the movable bodies which are moved up and down by the elevation sections 69, and the medium detection section 102 detects a relative height of (the surface of) the recording medium A with respect to the movable bodies. With such a configuration, the medium detection section 102 detects a relative position (height) of the surface of the recording medium A with respect to the recording head 52 and detects the distance between the nozzle surface of the recording head 52 and the recording medium A.

The first detection section 121 includes a contact piece 151 with a rotatably supported base and a contact-type sensor section 153 which detects rotation of the contact piece 151, causes the contact-type sensor section 153 to detect whether or not the contact piece 151 has been rotated due to contact with the recording medium A, and detects whether or not the distance between the nozzle surface of the recording head 52 and the recording medium A is less than the first predetermined value L1 (a detailed description will be given later).

The second detection section 122 includes a light emitting and receiving section 129 and a reflection section 130 which are arranged so as to face each other with the support stage 11 interposed therebetween. The light emitting and receiving section 129 irradiates the reflection section 130 with detection light and receives the detection light reflected by the reflection section 130. That is, since the recording medium A interrupts the detection light if the distance between the nozzle surface of the recording head 52 and the recording medium A is equal to or less than the second predetermined value L2, the light emitting and receiving section 129 does not receive the detection light. In contrast, since the recording medium A does not interrupt the detection light when the distance between the nozzle surface of the recording head 52 and the recording medium A exceeds the second predetermined value L2, the light emitting and receiving section 129 receives the detection light. As described above, the second detection section 122 detects whether or not the distance between the nozzle surface of the recording head 52 and the recording medium A exceeds the second predetermined value L2 based on whether or not the detection light has been received.

The elevation collision detection section 103 includes a plurality of contact members 131 arranged on the lower surface side of the overlapped portion 12*b* so as to face the support stage 11 and be longitudinally and laterally aligned and a plurality of elevation sensor sections 132 which are respectively arranged on the rear surfaces (upper sides) of the respective contact members 131 and detects behaviors of the respective contact members 131. The respective contact members 131 are contacts which are brought into contact with a foreign matter and detect collision. In contrast, the respective elevation sensor sections 132 are detectors which detect movement of the contacts caused by the contact with the foreign matter and detect collision.

Figure 9A:
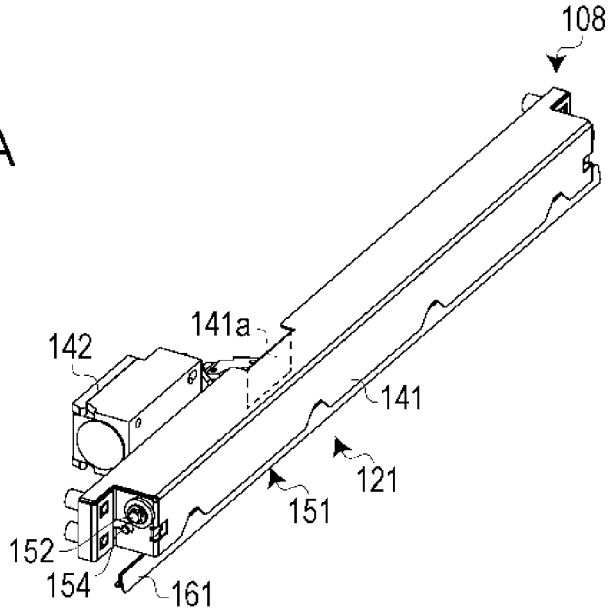
FIGS. 9A, 9B, and 9C are a perspective view, a front view, and a cross-sectional view showing a rear collision detection section and a first detection section taken along the line IXC-IXC, respectively.
Figure 9B:
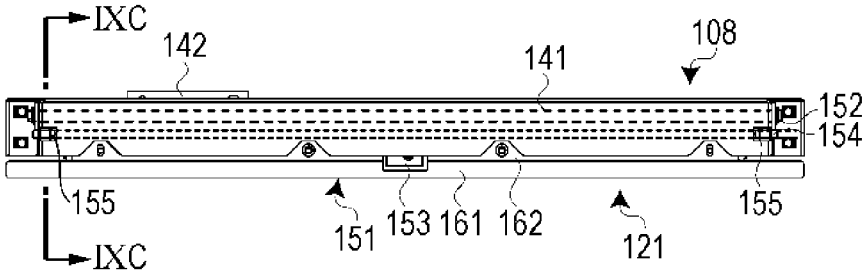
Figure 9C:
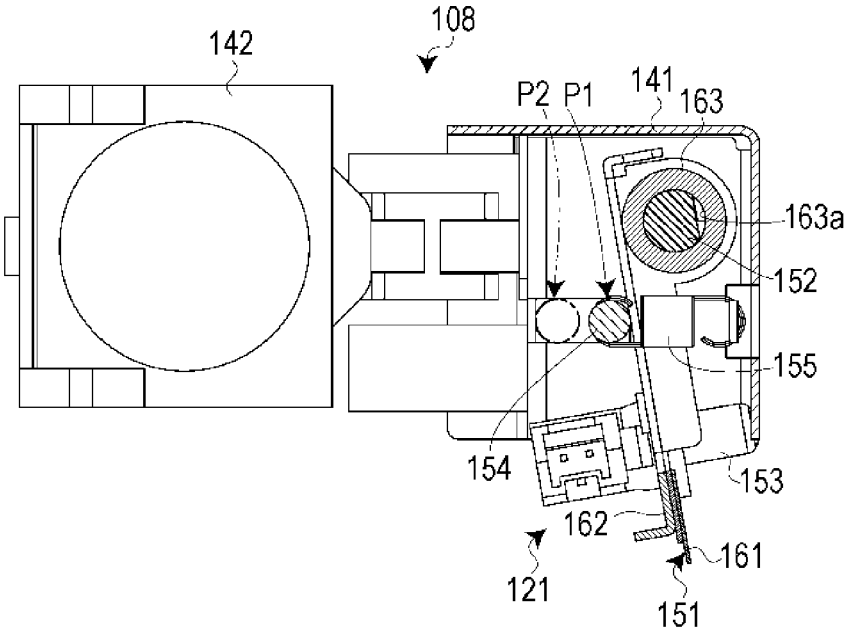

Here, a description will be given of the rear collision detection section 108 and the first detection section 121 with reference to FIGS. 7 to 9. As shown in FIGS. 7 to 9, the rear collision detection section 108 includes, on the rear side of the overlapped portion 12*b*, a rear bumper section (bumper section) 141 which is arranged at the lower end of the overlapped portion 12*b* and a rear sensor section (sensor section) 142 which is arranged on the rear surface side (front side) of the rear bumper section 141 and detects a behavior of the rear bumper section 141.

The rear bumper section 141 is a contact which is brought into contact with a foreign matter or the recording medium A and detects collision, and is formed into a box shape with an opened rear surface and an opened lower surface. In addition, the rear bumper section 141 is supported so as to freely advance and retreat in the front-back direction with respect to the apparatus cover 36 and is biased in a direction away from the apparatus cover 36 by a pressurizing spring, which is not shown in the drawing. The rear bumper section 141 absorbs impact when a foreign matter collides, by a hollow structure thereof and bias force of the pressurizing spring. In addition, the rear bumper section 141 has a width (the length in the X-axis direction) covering the entire width of the overlapped portion 12*b*.

In contrast, the rear sensor section 142 is a contact-type detector which is brought into contact with a contact target section 141*a* provided on the rear surface side of the rear bumper section 141, detects movement of the rear bumper section 141 caused by contact with a foreign matter or the recording medium A, and detects collision with the foreign matter or the recording medium A.

In addition, the rear collision detection section 108 is arranged such that the recording medium A is brought into contact with the rear bumper section 141 when the height of the recording medium A is equal to or greater than the predetermined first upper limit value h1, in the same manner as the front collision detection section 106.

As shown in FIG. 9, the first detection section 121 is mounted on the rear bumper section 141 such that a part thereof is arranged inside the rear bumper section 141. The first detection section 121 includes a contact piece (contact section) 151 which can be brought into contact with the surface of the recording medium A when the recording processing section 12 moves, a rotation shaft 152 which is supported by the rear bumper section 141 at both right and left ends thereof and rotatably supports the base of the contact piece 151, a contact-type sensor section (rotation detection section) 153 which is arranged on the contact piece 151 and detects rotation of the contact piece 151 in contact with the recording medium A, a bar-shaped posture maintaining member 154 which is brought into contact with the contact piece 151 on the front surface side thereof and maintains the contact piece 151 in a detection posture inclined backward from an erecting posture, and a pair of right and left bias springs 155 which bias backward the posture maintaining member 154 at the right and left ends thereof. If the recording medium A is brought into contact with the tip end of the contact piece 151 in the detection posture when the recording processing section 12 moves, the contact piece 151 rotates backward, and the contact-type sensor section 153 detects the rotation. With such an operation, whether or not the distance between the nozzle surface of the recording head 52 and the recording medium A is less than the first predetermined value L1 (whether or not the height up to the surface of the recording medium A exceeds the second upper limit value h2) is detected.

The contact piece 151 includes a contact plate section 161 which is brought into contact with the recording medium A, a plate-shaped fixing member 162 with the contact plate section 161 fixed to the tip end side thereof, and a pair of right and left attachment plate sections 163 formed so as to be bent backward from both the right and left ends of the fixing member 162 on the base end side and include shaft penetrating holes 163*a* into which the rotation shaft 152 is inserted. The contact plate section 161 has a width (the length in the X-axis direction) covering the entire width of the recording medium A.

The contact plate section 161 is fixed to the fixing member 162 such that the height thereof can be adjusted. By the height adjustment, the contact piece 151 is adjusted to be rotated by contact with the recording medium A when the distance between the nozzle surface of the recording head 52 and the recording medium A is less than the first predetermined value L1, and not to be in contact with the recording medium A when the distance between the nozzle surface and the recording medium A is equal to or greater than the first predetermined value L1. Here, the expression "not to be in contact" herein includes not only a case where the recording medium A and the contact pieces 151 are completely not in contact with each other but also a case where the contact-type sensor section 153 does not detect rotation of the contact piece 151 even when the recording medium A and the contact piece 151 are in contact with each other and a case where a detected rotation angle of the contact piece 151 is equal to or less than a predetermined rotation angle set in consideration of a detection error and the like even when the recording medium A and the contact piece 151 are in contact with each other and the contact-type sensor section 153 detects rotation of the contact piece 151. In addition, a detection available range in which the first detection section 121 can normally perform detection is greater than the second upper limit value h2 and equal to or less than the first upper limit value h1. That is, the detection available range by the first detection section 121 and the detection available ranges by the front collision detection section 106 and the rear collision detection section 108 are configured to be partially overlapped.

The contact-type sensor section 153 is fixed to the fixing member 162 at the center in the X-axis direction so as to face the inner surface of the rear bumper section 141 on the front surface side. In addition, the contact-type sensor section 153 is always in contact with the inner surface of the rear bumper section 141 on the front surface side and is relatively pressurized toward the inner surface of the rear bumper section 141 when the contact piece 151 in contact with a foreign matter rotates. The contact-type sensor section 153 detects the rotation of the contact piece 151 by detecting the pressurization.

The posture maintaining member 154 is configured of a bar-shaped member which is brought into contact with a front side of the fixing member 162 and is supported at both the right and left ends by the rear bumper section 141 so as to freely slide in the front-back direction. Specifically, the posture maintaining member 154 is supported so as to freely slide between a pressing position P1 at which the front side of the contact piece 151 is pressed and a retreat position P2 retreating forward from the pressing position P1. In contrast, each bias spring 155 includes one end latched by the rear bumper section 141 and the other end latched by the posture maintaining member 154, and biases backward the posture maintaining member 154. The posture maintaining member 154 is always pressed toward the fixing member 162 of the contact piece 151 and biased to the side of the pressing position P1 by the bias force of the pair of bias springs 155. That is, the contact piece 151 is maintained in a detection posture inclined backward from the erecting state by the posture maintaining member 154 pressurizing the contact piece 151 by the bias force of the pair of bias springs 155. More strictly, the contact piece 151 is maintained in the detection posture by a balance between reactive force received by the contact-type sensor section 153 from the inner surface of the rear bumper section 141 and the bias force of the pair of bias springs 155.

In addition, the posture maintaining member 154 is supported so as to freely slide and is pressurized to the side of the pressing position P1 by the bias force of the pair of bias springs 155. Accordingly, the posture maintaining member 154 is configured to retreat forward against the bias force of the pair of bias springs 155 when strong burden to the front side is applied to the contact piece 151. With such a configuration, the posture maintaining member 154 retreats forward and permits rotation of the contact piece 151 to the front side when the recording processing section 12 is moved from the front side to the rear side in the Y-axis direction and a foreign matter or the recording medium A is brought into contact (collides) with the contact piece 151.

Next, a description will be given of a recording operation by the recording apparatus 1 with reference to FIG. 10. The recording operation is configured of a preliminary operation of moving the recording unit 31 from the rear side (far side) to the front side (near side) in the Y-axis direction to perform abnormality detection and a main operation of moving the recording unit 31 from the front side (near side) to the rear side (far side) in the Y-axis direction after the preliminary operation to perform recording processing.

Figure 10:
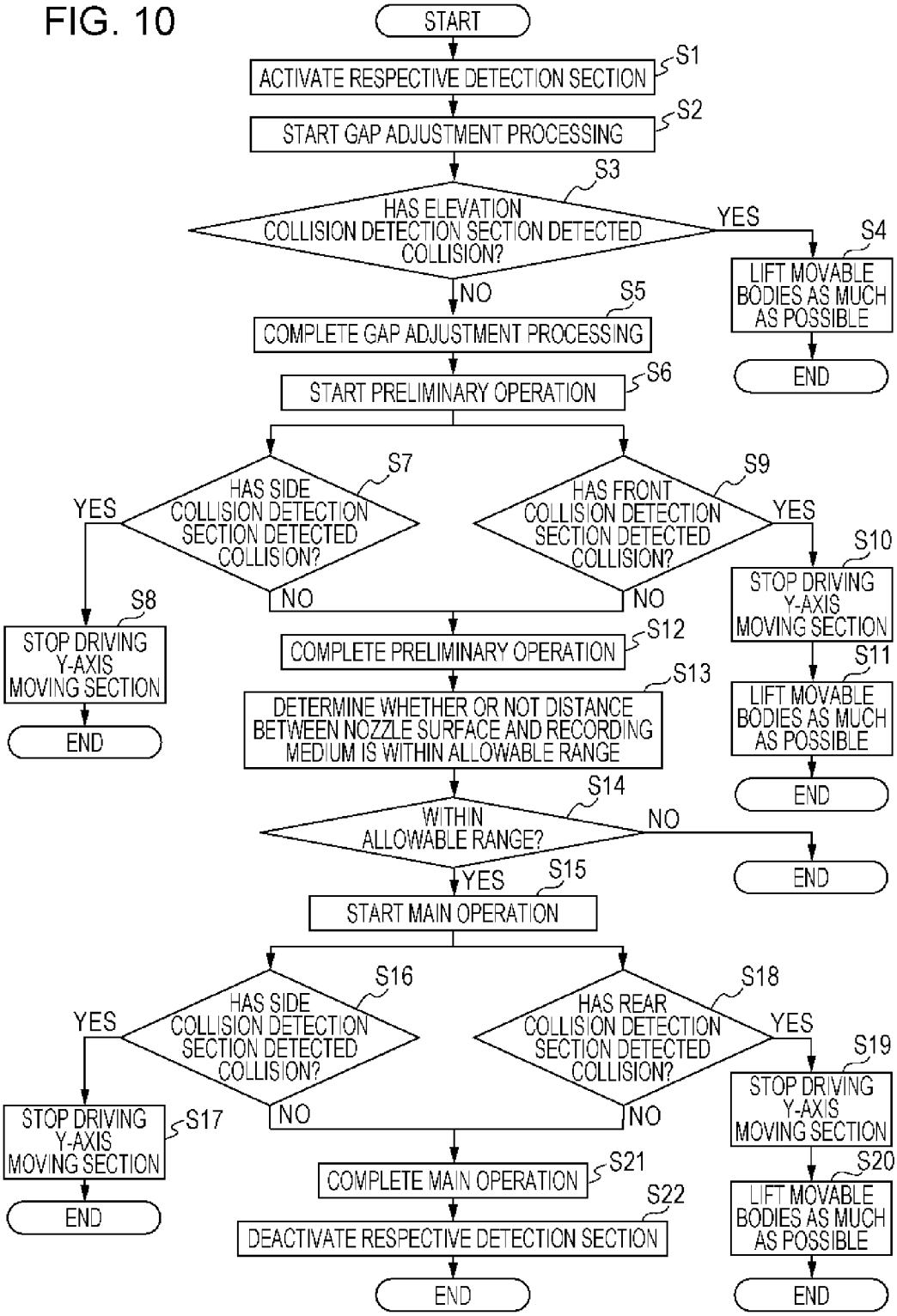
FIG. 10 is a flowchart showing a recording operation by the recording apparatus.

As shown in FIG. 10, the recording apparatus 1 first causes the control mechanism 15 to activate (ON) the collision detection sections 101, the medium detection section 102, and the elevation collision detection section 103 (S1) and then starts gap adjustment processing (S2). In the gap adjustment processing, the recording apparatus 1 drives the elevation sections 69 based on the thickness (height) of the recording medium A or a gap value input by the user and moves the recording unit 31 up and down such that the interval between the surface of the recording medium A and the nozzle surface of the recording head 52 becomes a predetermined gap. If the elevation collision detection section 103 detects collision (pinching) of a foreign matter at this timing (S3: Yes), the control mechanism 15 controls the elevation section 69 in response to the detection, lifts the movable bodies as much as possible (S4), causes the operation panel 24 to provide information about the error, and completes the recording operation.

In contrast, if the gap adjustment processing is completed (S5) without detecting collision of a foreign matter (S3: No), the preliminary operation is started (S6). In the preliminary operation, the Y-axis moving section 13 is driven, and the recording processing section 12 is moved from the rear side to the front side in the Y-axis direction in a state where the respective detection sections are activated and the recording unit 31 is moved to a home position P (see FIG. 8) at a right end in the X-axis direction. If the side collision detection section 107 detects collision of a foreign matter at this timing (S7: Yes), the control mechanism 15 stops driving the Y-axis moving section 13 in response to the detection (S8), causes the operation panel 24 to provide information about the error, and then completes the recording operation. In contrast, if the front collision detection sections 106 detect collision of a foreign matter or the recording medium A (S9: Yes), the control mechanism 15 stops driving the Y-axis moving section 13 in response to the detection (S10), controls the elevation sections 69 to lift the movable bodies as much as possible (S11), causes the operation panel 24 to provide information about the error, and then completes the recording operation.

In contrast, if the preliminary operation is completed (S12) without detecting collision of a foreign matter and the recording medium A (S7: No, S8: No), the control mechanism 15 determines whether or not the distance (the height of the recording medium A) between the nozzle surface of the recording head 52 and the recording medium A is within an allowable range (equal to or greater than the lower limit value L1 and equal to or less than the upper limit value L2) based on the detection result by the medium detection section 102 which is currently performing the preliminary operation (S13). That is, if the contact-type sensor section 153 of the first detection section 121 does not detect rotation of the contact piece 151 even once during the preliminary operation, and the light emitting and receiving section 129 of the second detection section 122 does not detect reception of the detection light even once during the preliminary operation, it is determined that the distance (the height of the recording medium A) between the nozzle surface and the recording medium A is within the allowable range. In contrast, if the contact-type sensor section 153 detects rotation of the contact piece 151 or the light emitting and receiving section 129 detects reception of the detection light during the preliminary operation, it is determined that the distance (the height of the recording medium A) between the nozzle surface and the recording medium A is outside the allowable range. If it is determined that the distance (the height of the recording medium A) between the nozzle surface and the recording medium A is without the allowable range (S14: No), the recording operation is completed without performing the main operation.

In contrast, if it is determined that the distance (the height of the recording medium A) between the nozzle surface and the recording medium A is within the allowable range (S14: Yes), the main operation is started (S15). In the main operation, the recording head 52 is made to eject ink while the recording processing section 12 is intermittently moved from the front side to the rear side in the Y-axis direction and the recording unit 31 is moved in the X-axis direction by the X-axis moving section 32. If the side collision detection section 107 detects collision of a foreign matter at this timing (S16: Yes), the control mechanism 15 stops driving the Y-axis moving section 13 in response to the detection (S17), causes the operation panel 24 to provide information about the error, and then completes the recording operation. In contrast, if the rear collision detection section 108 detects collision of a foreign matter or the recording medium A (S18: Yes), the control mechanism 15 stops driving the Y-axis moving section 13 in response to the detection (S19), controls the elevation sections 69 to lift the movable bodies as much as possible (S20), causes the operation panel 24 to provide information about the error, and then completes the recording operation.

In contrast, if the main operation is completed (S21) without detecting collision of a foreign matter or the recording medium A (S16: No, S18: No), the respective detection sections are deactivated (OFF) (S22), and the recording operation is completed.

According to the aforementioned configuration, it is not necessary to provide a special arrangement space for the first detection section 121 by arranging the first detection section 121 by using the inner space of the rear bumper section 141 for absorbing impact. Accordingly, it is possible to arrange the first detection section 121 efficiently in terms of a space and to reduce the size of the recording apparatus 1 as a whole.

In addition, it is possible to detect that a foreign matter has collided with the recording processing section 12 by providing the rear sensor section 142 for detecting a behavior of the rear bumper section 141 and to thereby quickly stop driving the Y-axis moving section 13, for example, at this timing.

Furthermore, it is possible to detect that the distance between the recording medium A and the recording unit 31 is less than the predetermined value (first predetermined value L1) with a simple configuration, in which the first detection section 121 is configured of the contact piece 151, the rotation shaft 152, and the contact-type sensor section 153, without damaging the surface of the recording medium A as much as possible. In addition, it is possible to detect whether or not the distance between the recording medium A and the recording unit 31 is less than the predetermined value at the respective positions in the Y-axis direction and to thereby detect unevenness or bending (floating) even when the unevenness or the bending (floating) occurs in the Y-axis direction and the distance is partially less than the predetermined value.

Furthermore, it is not necessary to provide a special arrangement space for the contact-type sensor section 153 by arranging the contact-type sensor section 153 on the contact piece 151. Accordingly, it is possible to reduce the size of the first detection section 121 and to easily arrange the first detection section 121 inside the rear bumper section 141.

In addition, it is possible to release strong burden applied on the contact piece 151 and to thereby prevent the contact piece 151 and the recording medium A from being damaged with the configuration in which the posture maintaining member 154 can retreat forward against the bias force of the pair of bias springs 155, even if the recording medium A is brought into contact (collides) with the contact piece 151 from the rear side during the recording operation or the like.

Although this embodiment is configured such that the single contact piece 151 and the single contact-type sensor section 153 for detecting rotation of the contact piece 151 perform the upper limit detection, a configuration in which the first detection section 121 includes a plurality of contact pieces 151 aligned and arranged in the X-axis direction and a plurality of contact-type sensor sections 153 for respectively detecting rotation of the respective contact pieces 151 and the plurality of contact pieces 151 and the plurality of contact-type sensor sections 153 performs the detection is also applicable. In such a case, the plurality of contact pieces 151 are aligned and arranged in the X-axis direction, and a total width of the plurality of contact pieces 151 in the X-axis direction is a width covering the recording medium A. According to such a configuration, it is possible to precisely detect unevenness or bending (floating) when the unevenness or the bending (floating) occurs in the X-axis direction and the distance is partially less than the predetermined value. Furthermore, since each contact piece 151 has a width narrower than the width of the recording medium A, the contact pieces 151 are not easily bent, and it is possible to precisely form a tip end (an end on the side of the recording medium A) and to arrange the contact pieces 151 at locations which are as close as possible to the recording medium A (improvement in detecting precision).

In the configuration in which the first detection section 121 includes the plurality of contact pieces 151 and the plurality of contact-type sensor sections 153, an informing section (a display section, for example) for informing about a detection result of each contact-type sensor section 153 may be further provided. According to such a configuration, it is possible for a user to easily recognize at which position in the X-axis direction on the recording medium A unevenness or bending (floating) occurs.

Furthermore, although this embodiment is configured such that the first detection section 121 is mounted on the rear bumper section 141, a configuration in which the first detection section 121 is mounted on the front bumper section 111 is also applicable. In such a case, the first detection section 121 is mounted on the front bumper section 111 such that a part of the first detection section 121 is arranged inside the front bumper section 111.

Although the present invention is applied to the recording apparatus 1 which performs recording by moving the recording unit 31 in the X and Y directions in this embodiment, a configuration in which the present invention is applied to a recording apparatus 1 (a so-called line printer) which performs recording by moving the recording unit 31 with a line head only in the Y-axis direction is also applicable.

Furthermore, although the second detection section 122 of this embodiment is configured such that the light emitted from the light emitting and receiving section 129 is blocked by the side surface of the recording medium A, a configuration in which the light emitted from the light emitting and receiving section 129 is blocked by the side surface of the support stage 11 is also applicable. That is, any configuration is applicable as long as the detection light is interrupted when the distance between the nozzle surface of the recording head 52 and the recording medium A is equal to or less than the second predetermined value L2. In addition, although a contact-type detection mechanism and an optical-type detection mechanism are employed as the first detection section 121 and the second detection section 122, respectively, the configurations of the detection mechanisms for the first detection section 121 and the second detection section 122 are not limited to the aforementioned configurations.

The entire disclosure of Japanese Patent Application No. 2013-065985, filed Mar. 27, 2013 is expressly incorporated by reference herein

What is claimed is:

1. A recording apparatus comprising:

a stage which includes a support surface for supporting a recording medium;

a recording processing section which includes a recording unit for performing recording on the recording medium supported by the stage and is bridged so as to cross over the stage in a first direction;

a moving section which moves the recording processing section in a second direction perpendicular to the first direction and along the support surface, with respect to the stage;

a bumper section which is arranged on at least one of one side and the other side of the recording processing section in the second direction and absorbs impact when a foreign matter collides; and a detection section which detects whether or not a distance between the recording medium and the recording unit in a facing direction of the recording unit and the stage is less than a predetermined value, wherein at least a part of the detection section is arranged inside the bumper section.

2. The recording apparatus according to claim 1, further comprising:

a sensor section which detects a behavior of the bumper section which collides with the foreign matter.

3. The recording apparatus according to claim 1, wherein the detection section includes a contact section which is able to be brought into contact with the recording medium, a rotation shaft which is supported by the bumper section and rotatably supports a base of the contact section, a posture maintaining member which maintains a posture of the contact section, and a rotation detection section which detects rotation of the contact section in contact with the recording medium.

4. The recording apparatus according to claim 3, wherein the rotation detection section is fixed to the contact sections, is relatively pressurized toward an inner surface of the bumper section during the rotation, and detects the rotation of the contact sections by the pressurization.

5. The recording apparatus according to claim 3, wherein the bumper section supports the posture maintaining member such that the posture maintaining member freely slides between a pressing position at which the contact sections are pressed and a retreat position retreating from the pressing position, and wherein the detection section further includes a bias spring which biases the posture maintaining member to a side of the pressing position.

6. The recording apparatus according to claim 1, wherein the detection section includes a plurality of contact sections which are aligned and arranged in the first direction and are able to be brought into contact with the recording medium when the recording processing section moves, a rotation shaft which is supported by the bumper section and rotatably supports bases of the plurality of contact sections, a posture maintaining member which maintains postures of the plurality of contact sections, and a plurality of rotation detection sections which respectively detect rotation of the respective contact sections in contact with the recording medium.

7. The recording apparatus according to claim 6, further comprising:

an informing section which provides information about detection results of the respective rotation detection sections.

* * * * *